US005460102A

United States Patent [19]

Pasmanick

[11] Patent Number: 5,460,102

[45] Date of Patent: Oct. 24, 1995

[54] PORTABLE WORK AND PLAY STATION FOR A CHILD

[76] Inventor: Victoria I. Pasmanick, 3325 N. Embry Cir., Atlanta, Ga. 30341

[21] Appl. No.: 177,459

[22] Filed: Jan. 5, 1994

[51] Int. Cl.[6] ..... A47B 23/00

[52] U.S. Cl. ..... 108/43; 108/25

[58] Field of Search ..... 108/44, 45, 43, 108/25, 26; 248/441.1, 444, 444.1

[56] References Cited

U.S. PATENT DOCUMENTS

| | | | |
|---|---|---|---|
| 551,256 | 12/1895 | Brown | 108/49 X |
| 3,899,119 | 8/1975 | Roccaforte . | |
| 4,052,498 | 8/1977 | Judd | 108/43 |
| 4,052,944 | 10/1977 | Jennings | 108/43 |
| 4,311,099 | 1/1982 | Roberts . | |
| 4,312,507 | 1/1982 | Smith et al. | 108/25 X |
| 4,512,503 | 4/1985 | Gioso . | |
| 4,700,634 | 10/1987 | Mills et al. | 108/43 |
| 4,765,583 | 8/1988 | Tenner | 108/43 X |
| 4,795,210 | 1/1989 | Milat . | |
| 4,940,003 | 7/1990 | Mayhew et al. . | |
| 5,055,081 | 10/1991 | Nayak | 108/26 X |
| 5,081,936 | 1/1992 | Drieling | 108/43 |
| 5,218,912 | 6/1993 | Buske | 108/26 |

*Primary Examiner*—Jose V. Chen
*Attorney, Agent, or Firm*—Jones & Askew

[57] ABSTRACT

A portable work and play station particularly suited for a child traveling in an automobile or airplane is disclosed. A planar work surface is provided to which a clip for holding a workpiece in place is attached. The work surface is supported by a deformable support bag, preferably filled with particulate materials so as to rest on a child's legs while in use. Covered rectangular storage wells for writing instruments are provided and circular wells for drinks are included. An interior storage volume is provided for paper and other apparatus as well as a book holding device. Single piece and two piece folding configurations are disclosed.

36 Claims, 2 Drawing Sheets

PORTABLE WORK AND PLAY STATION FOR A CHILD

TECHNICAL FIELD

The present invention is in the field of portable work and play surfaces and the field of portable desks for use in relatively cramped quarters, and more particularly is a portable work and play station for children particularly suited for, but not limited to, use by a child in a confined seat such as in an automobile or airplane.

BACKGROUND OF THE INVENTION

As all parents know, occupying the attention of young children when they are confined to a relatively small space in which limited physical activity is possible is one of the major challenges of day-to-day life with children in modern times. In the United States, the difficulty of this has been exacerbated for the last 40 years which have witnessed the widespread proliferation of television as a principal mechanism for occupying the attention, or dulling the sensibilities, of children when they are not engaged in outdoor activities. Thus, in modern times, parents are often faced with the aphorism that the confined child can become the mischievous or complaining child.

As most parents know, the problems of keeping peace within a family group in a confined space can be particularly trying when family groups are traveling in automobiles. In earlier times, this was somewhat less of a problem as children had a fair amount of freedom to roam throughout the interior of an automobile. However, modern sensitivity to safety issues has led to a situation in which children are essentially confined to a particular seating area while traveling in an automobile. In particular, the great increase in probability of survival and avoidance of serious injury in the event of an automotive crash when a child is securely fastened within a child safety seat (for younger children) or restrained by shoulder and lap restraints has made it difficult to provide a child with the opportunity to entertain himself or herself during long automotive trips.

Every parent who has passed through the single digit years with a child is also aware of the problems associated with provision of materials for reading, drawing, and the like to a child in a car seat. While free standing writing surfaces for holding paper, or upon which books can be placed are used by many parents, all parents know that children invariably drop something at the height of some crisis of the automotive driver maneuvering the vehicle through traffic. This leads to a frustrated child who cannot reach his or her books, crayons, or whatever material was dropped and a parent who is understandably and properly reluctant to turn his or her attention from the road to perform acts of contortion to try to retrieve the dropped object from the floorboard of the car.

Common experience also teaches that one of the more perilous activities for nerves, clothing, and upholstery is to have children consume beverages in a moving vehicle. They almost invariably forget the experiential laws of physics that govern continued movement of a drink cup in a forward direction when the surrounding vehicle is decelerating as brakes are applied. It is often true that accidents of this type occur as the child becomes truly engrossed in some worthwhile activity such as reading or drawing and ceases to pay appropriate attention to a drink container from which they are consuming a beverage.

While the foregoing has been presented with a bit of levity, it is well recognized that the situations described do lead to stressful interactions between parent and child and frustration for both. Particularly when children are confined to more rearward seats in a car or van, it can literally be impossible for a parent to assist a child in retrieving a dropped object without having to locate an appropriate and safe place to pull the vehicle out of traffic, exit the vehicle and reach into the portion of same occupied by the child to retrieve the dropped book, pencil, crayon, or similar object.

Thus, there is a need for an improved arrangement for holding work and play materials for children, as well as drinks, in an automotive or similar setting in a way that allows the child to make maximum use of materials at hand while minimizing the probability of dropping or spilling the materials the child needs to manipulate during car or air travel. It is also desirable to have such a device that is readily usable by a child in environments other than an automobile or airplane, both for purposes of serving as a portable desk and for getting the child used to working with the apparatus while not in the car, so as to be more comfortable and familiar with same while in a car.

A number of prior art attempts to fill this need have been proposed, all of which have some utility, but none of which provide the beneficial combination of structure and function provided by the present invention.

U.S. Pat. No. 4,940,003 to Mayhew et al. shows a table for use with a car seat. It includes a tray with a first level surface and a depressed center area for holding food and other items. A pair of circular holes with various sized gripping inserts are provided to accommodate beverage cans and cups of different sizes. An arrangement is made for passing a seat belt through the legs of the apparatus. This particular apparatus is designed to sit on the seat with a seat belt dedicated to holding it passing through its legs to secure it in place. In a typical back seat environment with two children, the inventors of the apparatus contemplate that it would occupy a center seat position and be secured by a conventional center seat belt. While it has multiple drink holders, it does not truly serve as a work station since it is not designed to provide access to a work surface directly in front of a child user.

U.S. Pat. No. 4,795,210 to Milat shows a portable table that is designed to provide a work or play station for a child traveling in an automobile. It includes a pair of parallel planks that serve as legs. The planks have contoured lower edges designed to fit on the contour of a seat. In one embodiment, the leg on one side is shorter than the leg on the other to accommodate having the shorter leg supported by an arm rest. It shows slots through the plank-like legs for accommodating the seat belt and an auxiliary strap disclosed as being for attaching the apparatus to a car seat. It includes a drink holding orifice and a bin to hold a limited number of pencils or crayons oriented vertically.

U.S. Pat. No. 4,512,503 to Gioso shows an elaborate organizer for attaching to the seat of an automobile for holding a wealth of devices, particularly of adult orientation, including cigarettes, tape cassettes and the like. Additionally, other lap tables and tray tables have been known in the art.

One of the main shortcomings of the prior art children's tables described above is their inclusion of peripheral rims about a working surface. While in principle this sounds like a good idea in that it keeps pencils, crayons and other paraphernalia from sliding off a work surface, experienced parents know that it does not conform to the way children tend to write and draw. In particular, many, if not most, children less than ten have a tendency to sprawl over a work area when writing or drawing, with forearms and elbows laid out on the work surface.

Additionally, while it is certainly desirable to have a portable work station for a child to use in an automobile be securable to a child's car seat or to a seat belt, arrangements such as those in the prior art for which there is a fixed geometric relationship between the contour of an automobile seat or child seat and the orientation of the work surface is much less desirable than an arrangement in which the child can manipulate the position of the work surface relatively easily. Furthermore, it is very desirable to have an arrangement where the child can copy or draw pictures based on the contents of a preexisting book or picture. Thus, it is desirable to have a portable child's work station, usable in an automobile, which will accommodate apparatus for holding a book in an open position.

In addition to holding a child's work or play utensils in usable positions while a portable work station is in use, it is also desirable that it readily accommodate materials to be carried from place to place when the portable work station is being transported. While the prior art work stations described above are designed to accommodate use in an automobile, they do not address the need to provide easily operable portable storage for the child's work and play materials that keeps the materials used at the work station physically together with the work station.

In summary, there is a need in the art for an improved thoughtfully designed work station for a child, particularly one usable in a confined area such as an automobile or airplane seat. There is also a need to provide such a work station that is suitable to the way children actually draw and write as well as to provide child operable storage for work materials such as paper, books, pencils, and crayons while the portable work station is in transport. It is further desirable to have such a work station that is readily transportable by a child so that the child may carry it from dwelling to automobile and vice versa. That the present invention overcomes the above cited drawbacks in the prior art and fulfills the above described needs will be become apparent from the following description.

SUMMARY OF THE INVENTION

The present invention provides apparatus that fulfills the above described needs by providing a substantially quadrilateral panel that forms a planar work surface. Within the work surface at least one rectangular storage well is provided preferably with a spring loaded top thereon and sized for holding children's writing instruments such as pens, pencils and crayons. In preferred forms, the well cover is only slightly raised, or flush with the planar work surface when in a closed position.

At least one substantially circular well is provided for holding drinks. This is preferably sized to hold a standard 12 ounce drink can but may be somewhat larger to accommodate fast food restaurant cups, and may be provided with inserts to secure smaller size drink containers. Additionally, the apparatus has some device for holding a workpiece, such as a piece of paper, in place on the work surface. This should preferably be located so that a line upon which it is held passes below the periphery of the drink holding wells.

In a first preferred embodiment, the workpiece holding device is a conventional spring loaded clip of the type commonly used on clipboards. In an alternate folding embodiment, a bar that is flexible under torsion is pivotally secured to one part of the planar work surface and may be rotated selectively to extend over a sheet of paper to hold it is place.

The present invention rests on a support bag attached to the underside of the panel forming the planar work surface. The support bag should be filled with a deformable material that will conform to the shape of a child's legs or a portion of a child's legs and a portion of the apparatus on a car seat. In its most preferred form, the support bag is filled with particulate matter such as sand, small Styrofoam pellets, beans, or the like so that overall the support bag has a deformable non-resilient characteristic. This allows it to conform to the shape of the parts of a person or automobile upon which it rests, not moving up and down with a springy movement as the child applies pressure to the surface, and also provides weight in order to stabilize the apparatus. However, embodiments of the present invention may be constructed in which deformable resilient materials fill the support bag, including fiberfill, air, and the like.

In preferred forms of the present invention, a storage volume is provided within the interior of the support bag for holding work materials such as paper, books and the like. It is preferred that such an opening have a selectively closeable flexible cover thereover to prevent the stored materials from falling when the work station is transported. It is a matter of design choice whether to fit the storage volume with a rigid shell in the form of a rigid box inserted within the interior of the support bag. The tradeoff is that the rigid box improves the protection offered to materials that may be crumpled, such as sheets of drawing paper and the like. However, this is achieved at a cost of either making the station somewhat less comfortable for the user or requiring that the work station be somewhat thicker in order to have a similar thickness of soft support material between the bottom side of the box and the user's legs.

In an alternative embodiment of the invention, the planar work surface is composed of two quadrilateral surfaces that are joined together, either permanently, or selectively, each of which is supported by a support bag. This allows the apparatus to be folded when in transport or not in use so as to be somewhat more compact.

Thus, it is an object of the present invention to provide an improved child's work station particularly suitable for use in an automobile or airplane in which child is confined and has relatively limited space.

It is a further object of the present invention to provide an improved work station that accommodates pens, pencils, crayons, and the like, and will keep them from falling off the surface, yet does not require a raised edge about the work surface to interfere with the child laying his or her forearms or elbows on the surface and does not require the child to place such writing instruments in small holes where they are held vertically.

It is a further object of the present invention to provide an improved child's work and play station that is easily portable, conforms to a wide variety of surfaces, including the legs or lap of the child using same and does not require special fitting to particular shapes of car seats, arm rests, and the like in particular vehicles.

It is still a further object of the present invention to provide an improved child's work station that accommodates drawing the way children actually perform it, will hold drinks and the like in place without spillage, and also provide apparatus for holding a book in an open readable position near an edge of the work surface so that the child may either read the book or copy or mimic material from the book on the workpiece.

That the present invention achieves these objects and overcomes the drawbacks of the prior art will be appreciated from the detailed description below.

DETAILED DESCRIPTION

Turning now to the drawings in which like numerals reference like parts, the preferred embodiment of the present invention will now be described.

Figure 1:
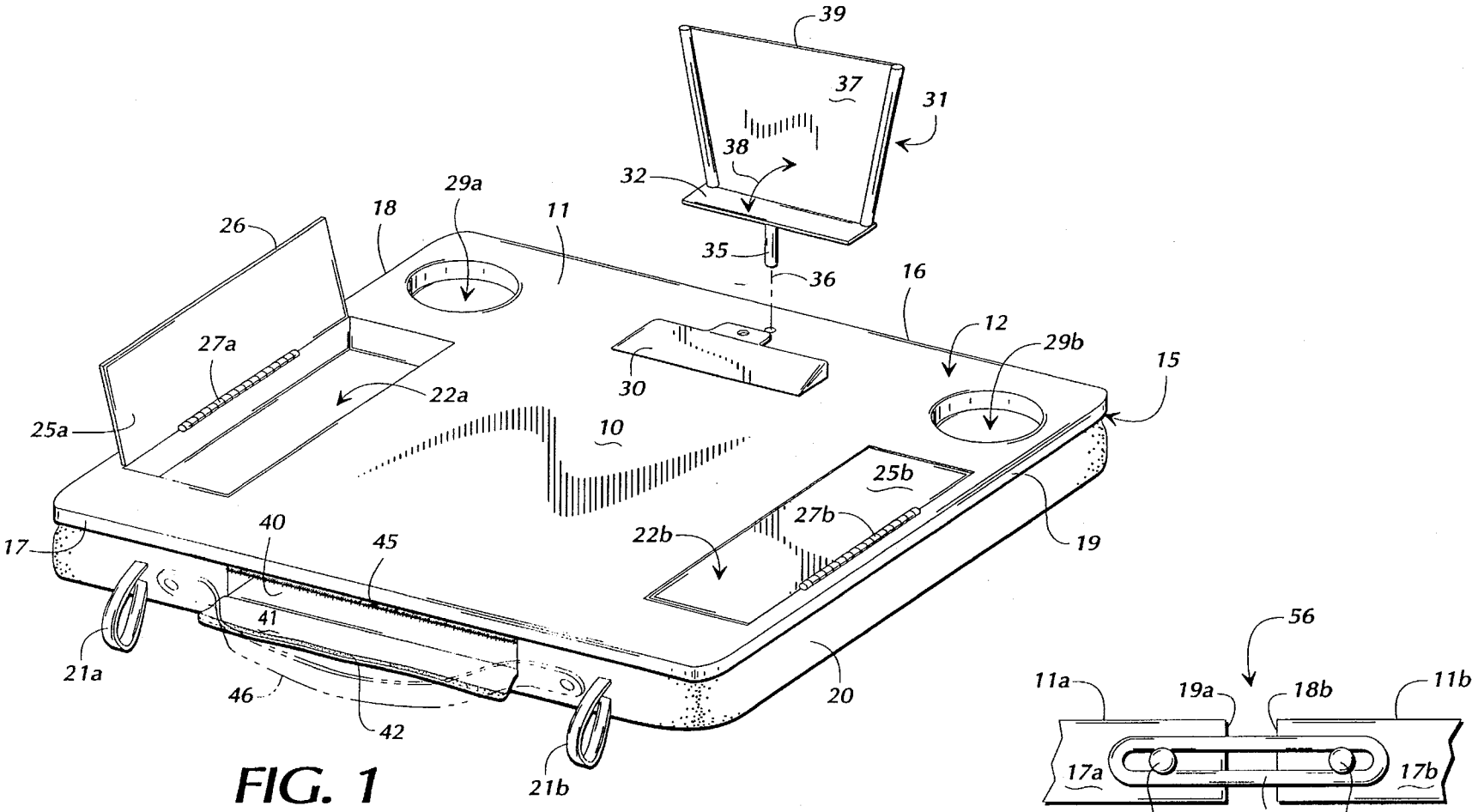
FIG. 1 is a pictorial view of a first preferred embodiment of the present invention.

FIG. 1 shows a first preferred single piece embodiment of the present invention. A planar work surface 10 is formed on the upper part of a substantially quadrilateral panel 11 preferably made of a hard plastic material. For purposes of defining the structure and use of the present invention, it should be observed that panel 11 has an upper face 12, a lower face 15 (not visible in FIG. 1), a distal edge 16, a proximal edge 17, left edge 18 and right edge 19. It will be appreciated from viewing the drawing figure, together with this description, that the distal and proximal edges are defined with respect to the way the user approaches same. Thus, proximal edge 17 is that nearest the torso and arms of the child using the device, while distal edge 16 is that farthest away. Left and right edges 18 and 19, respectively, refer to those on the left and right sides of the child.

Attached to lower face 15 of panel 11 is a deformable support bag 20. This is preferably formed of a unitary bag and glued to lower face 15, although it may be secured by screws, ultrasonic welding, hot melt adhesive, or any other known way of attaching plastic materials to each other. In the common parlance, the preferred form of support bag 20 is a "bean bag" type device. In other words, it is a flexible bag filled with relatively small and dense particulate matter so that the bag is relatively heavy, deformable so that it conforms to various contours upon which it is placed, and tends to be generally non-resilient. It should be understood that the relatively dense particulate matter and non-resilient characteristic of the support bag are preferred forms only in that it is considered within the scope of the present invention to include a support bag that is deformable and resilient, although it is believed that this is less desirable than heavy or non-resilient substances. Filling the bag with dense particulate matter allows it to be comfortably placed on the legs and lap of a child using same. Such a support bag will conform to the contour of the child's legs and clothing and not create relatively large pressures at small contact areas. It should also be noted that this arrangement does not in any way inhibit lateral movement of the child's legs or confine or restrict the knees in any way.

Included in the alternative materials with which support bag 20 can be filled are relatively dense gel materials and liquids, although these are considered less desirable. It should be noted that the support bag may be pneumatic in nature, i.e., can be selectively inflatable and deflatable. While this lacks the advantage of relatively dense non-resilient materials to fill the bag, it does provide for a very compact apparatus during storage and transport.

Attached to deformable support bag 20 in the preferred embodiment are a pair of elongated straps **21*a* and 21*b*. These should be of sufficient length, or be provided with auxiliary straps so that they may be attached to the seat belt or child's seat. They need to be relatively long, or fitted with relatively long auxiliary loops because the proximal edge 17 rests in front of a child's stomach and the ends of proximal edge 17 near left and right edges 18 and 19 are held away from a seat belt or car seat. Use of straps 21** is not required but it is desirable to have same available, particularly for use of the device by very small children who may have difficulty holding the apparatus on their laps.

In the preferred embodiment, two substantially rectangular storage wells **22*a* and 22*b* are provided, each of which is covered by a respective cover 25*a* and 25*b*. As shown on cover 25*a*, a lip 26 is preferably used to provide a finger hold by which the user may obtain purchase on the edge of cover 25*a* in order to open same. A conventional plastic tab spring 27*a* serves as both a hinge and a latching mechanism for the top. This type of device is well known to those skilled in art and includes a tab that acts as a leaf spring urging top 25*a* to a closed position, such as that shown for 25*b***, when it goes over center. The top will remain open when opened a sufficient distance. Naturally, any other spring mechanism, including coil springs with some form of slot past the axis of rotation for the top may be used so that the top will latch in either an opened or closed position as the force vector exerted by the spring passes through the axis of rotation. Alternately, the top may simply latch in the closed position and be free swinging in any open position.

As illustrated in FIG. 1, it is preferable to have two substantially rectangular storage wells, both to increase the storage space and to provide for the possibility of storing different types of writing utensils, such as crayons in one and pens and pencils in the other. It is also preferable, but not absolutely necessary, to have covers 25 be close to flush with the surface of planar work surface 10. This allows a child to move a workpiece to one side, covering one of the storage wells, the cover of which is closed, while alternately retrieving and returning writing instruments to the other, open, well. Additionally, the duplication of the wells near left and right edges 18 and 19 of work surface 10 allow the apparatus to easily accommodate left and fight handed children.

Substantially circular wells **29*a* and 29*b* are disposed on planar work surface 10 near distal edge 16**. These are designed for holding drinks and to prevent them from tipping over. Preferably they are sized to accommodate a standard 12 ounce drink can although larger or smaller ones may be used, and foam or other insets may be used to reduce the gauge of the cups or cans that will be secured within the wells. While only one is required, it is again preferable to provide one on each side to accommodate either left or right handed children. Also, the other well may be used to collect trinkets, paper trash, or other things that might otherwise be deposited on the floor of the automobile. It is also possible, although not preferred, to shape one of the wells so that it is rectangular and will accommodate a conventional single serving size juice box.

A spring loaded clip 30 is secured to planar work surface 10 near distal edge 16 and provides a means for holding a workpiece in a fixed position on the planar work surface.

While a conventional spring loaded clipboard type clip is preferred for the first embodiment shown in FIG. 1, any apparatus that may be operated by a child of average ability that could be used to hold one or more sheets of paper in place on planar work surface 10 is appropriate for embodying a means for holding a workpiece (i.e., a paper or booklet) in a fixed position on the planar work surface. For example, elastic straps, pivoting arms flexible under torsion (as are used in an alternate embodiment) and other devices that can hold sheet-like material in place should be considered equivalents of clip 30.

In the first preferred embodiment, a book holding device, generally indicated at 31 is employed. The book holding device includes a substantially horizontal tray 32 that has a mounting stanchion 35 secured to the bottom thereof and extending downwardly therefrom. Stanchion 35 is inserted into a hole (not visible in FIG. 1) under center line 36 for holding book holding device 31 in place. Tray 32 has a panel 37 connected thereto for supporting the spine and covers of an open book.

In the preferred embodiment, the angle, indicated by phantom 38, between the plane of tray 32 and panel 37 is slightly greater than orthogonal, preferably on the order of 100–110 degrees. While this is a preferred range, any range between an angle slightly less than 90 and one that holds a book so that it may be read by a child having an embodiment of the present invention on his or her lap will serve to hold the book in a book holding position. While not required, it may be desirable to include an auxiliary device connected to book holding apparatus 31 for keeping the covers and spine of the book in contact with panel 37. Spring clips, elastic bands and the like are readily apparent expedients for performing this function.

It is also possible to place the mounting hole for stanchion 35 in a relatively narrow extension from distal edge 16 so that tray 32 does not occupy an undue portion of planar work surface 10. However, this is not preferred because it creates a protrusion from distal edge 16 that might either be broken off, or injure a child during transport of the device.

In the preferred embodiment, top edge 39 of panel 37 is arranged so that it will fit under clip 30. This provides a convenient and unobtrusive way to store book holding device 31 when the apparatus of the first preferred embodiment is in transport.

Figure 4:
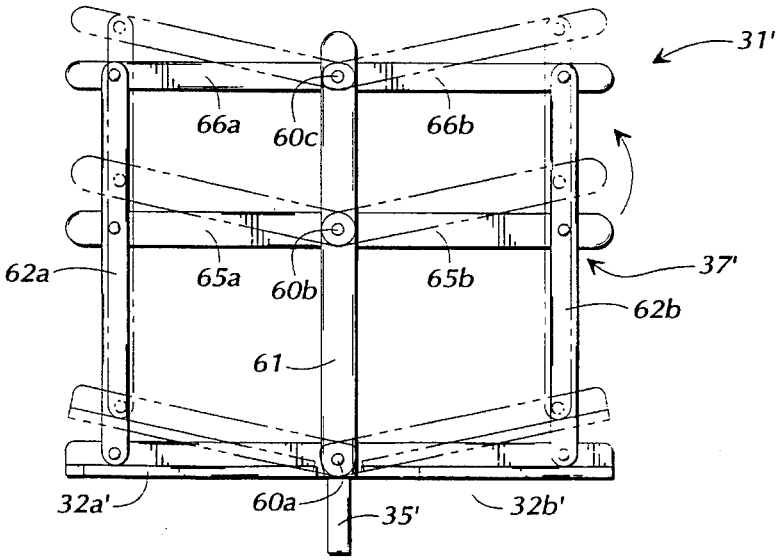
FIG. 4 is an elevational view of an alternate embodiment of the book holding device employed with the first preferred embodiment of the present invention.

Turning next to FIG. 4, an alternate apparatus for the book holding device, generally indicated as 31', is shown. In this embodiment, the tray is formed of two tray sections **32*a*' and 32*b*' pivotally joined by rivet 60*a*. Additional rivets 60*b* and 60*c* pass through a center bar 61. Side bars 62*a* and 62*b* are parallel to center bar 60**.

Rivets **60*b* and 60*c* each pass through respective pairs of horizontal bars 65*a*, 65*b*, and 66*a*, 66*b*, respectively. The distal ends of each of these bars is joined by other rivets to bars 62*a* and 62*b*. From the foregoing, it will be appreciated that the book holding apparatus of FIG. 4 comprises at least two tray sections 32*a*' and 32*b*' pivotally joined together by rivet 60*a* and the other members described above comprise a plurality of bars pivotally joined together in parallelogram relationship. While not illustrated explicitly in FIG. 4, it will be appreciated that the ends of bars 65 and 66 through which rivets 60*b* and 60*c* pass overlap each other so that the entire arrangement may be folded to an elongated but relatively narrow configuration, the beginning of the fold being illustrated in phantom in FIG. 4. It is preferable that this arrangement be sized so that the folded configuration can be stored in one of pencil wells 22*a* or 22*b* illustrated in FIG. 1. Those skilled in the art will recognize the alternate book holding apparatus of FIG. 4** to be a scaled down form of a music board employed in a conventional lightweight folding music stand.

Storage of paper, relatively thin books, and the like in the preferred embodiment is accomplished via a storage volume, indicated at 40, that is interior to support bag 20. Storage volume 40 extends for almost the entire distance between proximal edge 17 and distal edge 16 so that it will accommodate sheets of paper sized to fit on planar work surface 10.

The opening of storage volume 40 is selectively sealed by a flexible cover 41 having a strip of hook material 42 glued on the outer edge thereof that mates with a strip of eye material 45 glued above the opening of storage volume 40. The hook and eye material is used for selectively sealing and unsealing the opening by cover 41. Such materials are known to those skilled in the art as being similar to the hook and eye material sold under the trademark Velcro. Of course, other fasteners, including snaps, rigid covers that are connected to and latched to the peripheral edge of the opening, and similar covering devices may be used in constructing embodiments of the present invention.

It may also be desirable to employ a handle, shown in phantom as 46 in FIG. 1. While this handle may be disposed on any edge, it is considered preferable to position the handle so that it is on the same side of the apparatus as the opening to storage volume 40 so that the contents do not spill out when the apparatus is lifted by the handle, in case the child forgot to close cover 41.

While the inventor believes that the best mode of the present invention is to simply define storage volume 40 as an interior space within either support bag 20 (FIG. 1) or support bag **20*b* (FIG. 2**), certain advantages may be obtained by constructing an embodiment of the present invention in which the storage volume is defined by a rigid box inserted into the deformable support bag with the opening of the storage volume being an opening at one end of the rigid box. The advantage to be obtained is protection of materials stored within the storage volume from bending, crumpling and the like. The disadvantage is that, for a given thickness of the support bag, employment of a rigid box can make the work station somewhat less comfortable to a child upon whose legs the work station is resting. This can be overcome by increasing the thickness of the support bag but this is considered less desirable.

In embodiments of the present invention employing a rigid box for the storage volume 40, it is preferable that support bag 20 or **20*b* should be originally sewn or welded with a trough mtm to accommodate the box and that the box be glued to lower face 15 of planar work surface 10**.

From the foregoing description, it will be appreciated that the first preferred embodiment meets the above described needs, and provides a portable work and play station particularly suited for children that is particularly usable when traveling in an automobile. However, it should be noted that the use of same is not, in any practical way, limited to travel in an automobile or airplane. It may be used anyplace where a child can or must sit, and is sitting so as to have his or her lap formed. Thus, not only sitting in chairs will accommodate use of the present device, but sitting cross legged on the floor and even sitting in a chair with the station on a table will work. Thus, the apparatus can be transported easily from a car and used by the child in the same manner while waiting, for example, in a doctor's office.

Figure 2:
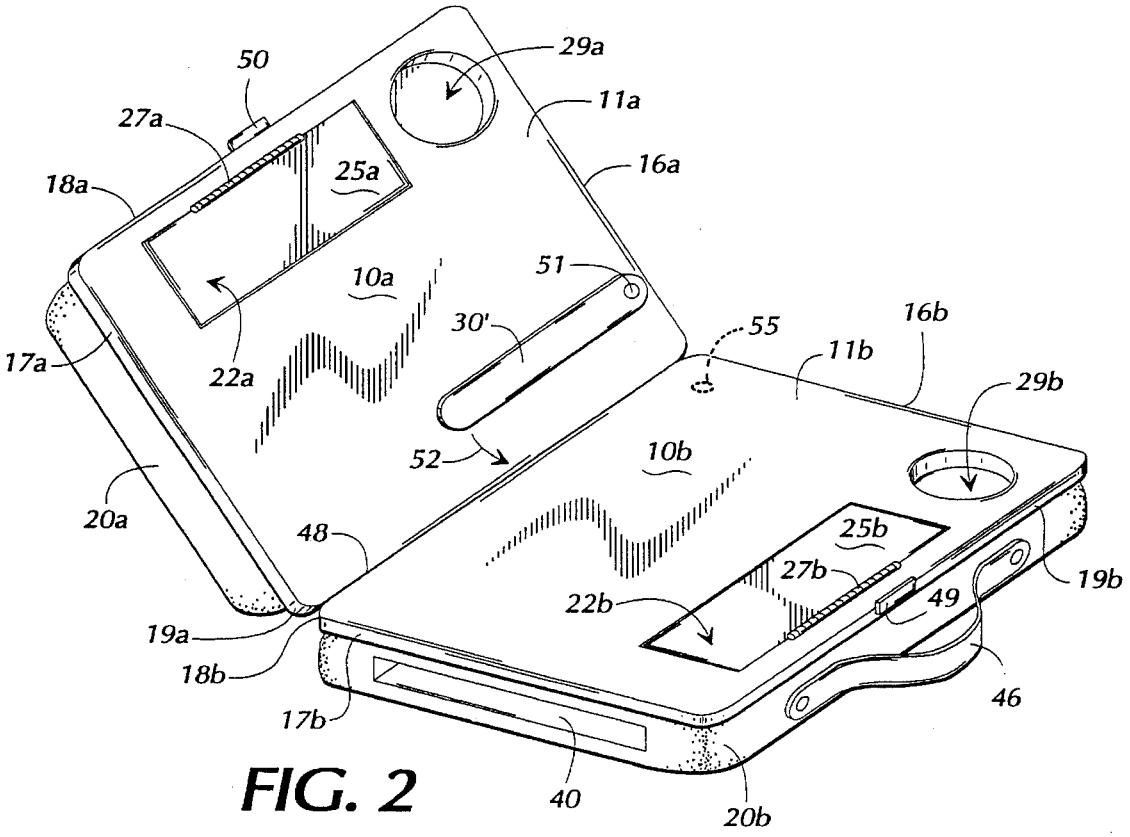
FIG. 2 is a pictorial view of an alternate folding embodiment of the present invention.

An alternate and more compact embodiment of the present invention is illustrated in FIG. 2. Therein, like numerals reference like parts for the first preferred embodiment. As may be seen in FIG. 2, planar work surface 10 is divided into two portions 10*a* and 10*b*. Each of these is formed by one of first and second quadrilateral panels 11*a* and 11*b* having left and right and distal and proximal edges that correspond to those for the single large panel in the embodiment of FIG. 1. Thus, proximal edges for each of panels 11*a* and 11*b* are referenced as 17*a* and 17*b*. As may be seen in FIG. 2, right hand edge 19*a* of panel 11*a* joins left hand edge 18*b* of right hand panel 10*b* at a plastic hinge indicated at 48.

In the second preferred embodiment, plastic hinge 48 is of a type commonly referred to as a "living hinge" which will be recognized by those skilled in the art as a relatively thin plastic web joining panels 11*a* and 11*b* along the entire length of hinge 48. Such hinges are deformable and resilient, and be constructed of nylon or a number of other plastic materials, all of which are matters of design choice in the present invention.

The structure for rectangular storage wells 22 in the second preferred embodiment is identical to that in the first preferred embodiment as are circular wells 29. Therefore, they need not be described repetitiously.

In the second preferred embodiment, separate deformable support bags 20*a* and 20*b* are provided under each of the respective panels 11*a* and 11*b*. These are otherwise identical in structure to support bag 20 illustrated in FIG. 1. In the second preferred embodiment, storage volume 40 is disposed within support bag 20*b*. It will likewise be fitted with a cover (not shown in FIG. 2) in the same manner as cover 41 illustrated in FIG. 1. In the second preferred embodiment, it is preferable to have handle 46 located as shown, and it may be desirable to duplicate handle 46 on support bag 20*a* so that there is no tendency for the apparatus to pop open while being carried by the handle. A conventional plastic closing device including a plastic latch 49 and a plastic hasp 50 are used to secure closure of the device when not in use or in transport.

In the second preferred embodiment, the apparatus for holding a workpiece in place is embodiment by a resilient flexible bar 30' pivoted about an axis defined by the longitudinal axis of plastic rivet 51. Bar 30' is flexible and resilient under torsion and thus may be lifted up to secure one or more sheets of paper under it for holding them in place on the composite planar work surface 10 that is formed of surfaces 10*a* and 10*b* when the embodiment of FIG. 2 is laid open. When the apparatus is laid open, arm 30' is rotated in the direction of arrow 52 to any convenient position for holding a workpiece in place. It should be noted that when rotated to extend over work surface 10*b*, flexible arm 30 arm also serves to hold surfaces 10*a* and 10*b* in their co-planar position and thus reduce any tendency of the apparatus to close up while support bags 20*a* and 20*b* are resting on left and right thighs of the user.

While not illustrated in FIG. 2, it is also possible to include a book holding device such as book holder 31 illustrated in FIG. 1 or the book holder illustrated in FIG. 4 in an embodiment of FIG. 2. Stanchion 35 should be fitted into a hole, located approximately where hole 55, illustrated in phantom, is shown in FIG. 2. In this arrangement the book holding apparatus may be carried separately, but it is preferably stored within pencil box 25*a* or 25*b* when not in use.

Figure 3:
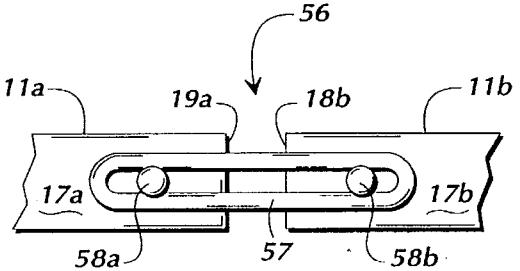
FIG. 3 is a detail of an alternate hinging arrangement for use in an embodiment such as that illustrated in FIG. 2.

While the use of a thin plastic hinge such as hinge 48 is preferred, there are other arrangements that, while more costly, may prove more durable, particularly under the abuses that a child can perform on a device. One alternative is illustrated as an alternate hinge 56 in FIG. 3. It should be understood that hinge 56 joins proximal edges 17, as illustrated in FIG. 3, and that an identical structure would be used to join distal edges 16 in an embodiment employing this hinge. An elongated loop 57 is provided through which rivets 58*a* and 58*b* pass into respective edges 17*a* and 17*b*. The heads of the rivets are sufficient to hold them in place and allow loop 57 to slide along these rivets. Therefore, when it is desired to close up the apparatus, panels 11*a* and 11*b* are pulled apart and then may be folded together. This give sufficient clearance between first fight side edge 19*a* and second left side edge 18*b* so that they may clear each other when the apparatus is folded. When in use, the user should urge panels 11*a* and 11*b* together. It may be desirable to provide some arrangement for securing these two together, such as some form of hook, latch, or even friction between rivets 58 and loop 57.

From the foregoing, it will be appreciated that the alternate preferred embodiments, the various equivalent structures described hereinabove fulfill the objects of the present invention and overcome the drawbacks of the prior art cited hereinabove. The present invention provides a practical and usable portable work station for a child that is designed to accommodate modern child safety devices in automobiles and to further accommodate the Way children actually draw and write. In view of the foregoing description, other embodiments and embellishments of the present invention will suggest themselves to those skilled in the art. Therefore, the scope of the present invention should be limited only by the claims below and equivalents thereof.

I claim:

1. A portable workstation, particularly suited for use by a child, comprising in combination:

a substantially quadrilateral panel forming a planar work surface on its upper face and having an opposing lower face, distal and proximal edges, and left and right edges;

a deformable support bag connected to said lower face of said substantially quadrilateral panel, said deformable support bag including a storage volume interior to said deformable support bag having an opening in a side wall of said deformable support bag, said opening being parallel to one of said distal, proximal, left or right edges of said planar work surface;

at least one substantially rectangular storage well formed in said planar work surface and having a selectively closeable cover disposed thereover, disposed near one of said left or right edges;

at least one substantially circular well formed in said planar work surface, disposed near said distal edge; and selectively operable means, connected to said planar work surface near said distal edge, for holding a workpiece in a fixed position on said planar work surface.

2. A portable workstation as recited in claim 1 wherein:

said deformable support bag is non-resilient.

3. A portable workstation as recited in claim 2 wherein said deformable support bag is filled with particulate matter.

4. A portable workstation as recited in claim 1 wherein:

said selectively closeable cover disposed over said substantially rectangular storage well is biased toward a closed position.

5. A portable workstation as recited in claim 1 wherein:

said selectively operable means for holding a workpiece includes a spring loaded clip.

6. A portable workstation as recited in claim 1 wherein:

said opening has a cover fitted thereover that is selectively and alternately operable for closing said opening and for providing access to said storage volume.

7. A portable workstation as recited in claim 1 further comprising securing means connected to said deformable support bag for selectively attaching said deformable support bag to a seat belt.

8. A portable workstation, particularly suited for use by a child, comprising in combination:

a substantially quadrilateral panel forming a planar work surface on its upper face and having an opposing lower face, distal and proximal edges, and left and right edges;

a deformable support bag connected to said lower face of said substantially quadrilateral panel, said deformable support bag including a storage volume interior to said deformable support bag having an opening in a side wall of said deformable support bag, said opening being parallel to one of said distal, proximal, left or right edges of said planar work surface;

at least one substantially rectangular storage well formed in said planar work surface and having a selectively closeable cover disposed thereover, disposed near one of said left or right edges;

at least one substantially circular well formed in said planar work surface, disposed near said distal edge; and book holding means, disposed near said distal edge, for holding a book in a reading position above said planar work surface.

9. A portable workstation as recited in claim 8 wherein:

said deformable support bag is non-resilient.

10. A portable workstation as recited in claim 9 wherein said deformable support bag is filled with particulate matter.

11. A portable workstation as recited in claim 8 wherein:

said selectively closeable cover disposed over said substantially rectangular storage well is biased toward a closed position.

12. A portable workstation as recited in claim 8 wherein:

said book holding means comprises a tray, a mounting stanchion secured to and extending downwardly from said tray, and a panel connected to said tray; and a receptacle located near said distal edge for receiving and holding said stanchion.

13. A portable workstation as recited in claim 12 wherein:

said tray is comprises at least two tray sections pivotally joined together and said panel comprises a plurality of bars pivotally joined in parallelogram relationship.

14. A portable workstation as recited in claim 8 wherein:

said opening has a cover fitted thereover that is selectively and alternately operable for closing said opening and for providing access to said storage volume.

15. A portable workstation as recited in claim 8 further comprising securing means connected to said deformable support bag for selectively attaching said deformable support bag to a seat belt.

16. A portable workstation, particularly suited for use by a child, comprising in combination:

a substantially quadrilateral panel forming a planar work surface on its upper face and having an opposing lower face, distal and proximal edges, and left and right edges;

a deformable support bag connected to said lower face of said substantially quadrilateral panel, said deformable support bag including a storage volume interior to said deformable support bag having an opening in a side wall of said deformable support bag, said opening being parallel to one of said distal, proximal, left or right edges of said planar work surface;

at least one substantially rectangular storage well formed in said planar work surface and having a selectively closeable cover disposed thereover, disposed near one of said left or right edges;

at least one substantially circular well formed in said planar work surface, disposed near said distal edge;

selectively operable means, connected to said planar work surface near said distal edge, for holding a workpiece in a fixed position on said planar work surface; and book holding means, disposed near said distal edge, for holding a book in a reading position above said planar work surface.

17. A portable workstation as recited in claim 16 wherein:

said deformable support bag is non-resilient.

18. A portable workstation as recited in claims 17 wherein said deformable support bag is filled with particulate matter.

19. A portable workstation as recited in claim 16 wherein:

said selectively closeable cover disposed over said substantially rectangular storage well is biased toward a closed position.

20. A portable workstation as recited in claim 16 wherein:

said selectively operable means for holding a workpiece includes a spring loaded clip.

21. A portable workstation as recited in claim 16 wherein:

said book holding means comprises a tray, a mounting stanchion secured to and extending downwardly from said tray, and a panel connected to said tray; and a receptacle located near said distal edge for receiving and holding said stanchion.

22. A portable workstation as recited in claim 21 wherein:

said tray is comprises at least two tray sections pivotally joined together and said panel comprises a plurality of bars pivotally joined in parallelogram relationship.

23. A portable workstation as recited in claim 16 wherein:

said opening has a cover fitted thereover that is selectively and alternately operable for closing said opening and for providing access to said storage volume.

24. A portable workstation as recited in claim 16 further comprising securing means connected to said deformable support bag for selectively attaching said deformable support bag to a seat belt.

25. A portable workstation, particularly suited for use by a child, comprising in combination:

a first substantially quadrilateral panel having a first upper face, an opposing first lower face, a first distal edge and a first proximal edge, and first left and first right edges;

a second substantially quadrilateral panel having a second upper face, an opposing second lower face, a second distal edge and a second proximal edge, and second left and second right edges;

hinge means for joining said first right edge to said second left edge for pivotal movement about a hinge axis so that said first and second substantially quadrilateral panels may be selectively opened to form a planar work surface;

first and second deformable support bags connected to said first and second lower faces of said of said first and second substantially quadrilateral panels, at least one of said first or second deformable support bags including a storage volume interior to said at least one deformable support bag having an opening in a side wall thereof;

at least one substantially rectangular storage well formed in said planar work surface and having a selectively closeable cover disposed thereover, disposed near one of said first left edge or said second right edges;

at least one substantially circular well formed in said planar work surface, disposed near said first distal edge or said second distal edge; and selectively operable means, disposed on said planar work surface near said first and second distal edges, for holding a workpiece in a fixed position on said planar work surface.

26. A portable workstation as recited in claim 25 wherein:

said first and second deformable support bags are non-resilient.

27. A portable workstation as recited in claim 26 wherein said first and second deformable support bags are each filled with particulate matter.

28. A portable workstation as recited in claim 25 wherein:

said selectively closeable cover disposed over said substantially rectangular storage well is biased toward a closed position.

29. A portable workstation as recited in claim 25 wherein:

said selectively operable means for holding a workpiece comprises a resilient flexible bar pivotally secured at one end thereof to said planar work surface.

30. A portable workstation as recited in claim 25 further comprising securing means connected to said first and second deformable support bags for selectively attaching said deformable support bag to a seat belt.

31. A portable work station, particularly suited for use by a child, comprising in combination:

a substantially quadrilateral panel forming a planar work surface on its upper face and having an opposing lower face, distal and proximal edges, and left and right edges;

a deformable support bag connected to said lower face of said substantially quadrilateral panel, said deformable support bag including a storage volume interior to said deformable support bag having an opening parallel to one of said distal, proximal, left or right edges of said planar work surface, said storage volume being defined by a rigid box inserted into said deformable support bag, wherein said opening is an opening at one end of said rigid box;

at least one substantially rectangular storage well formed in said planar work surface and having a selectively closable cover disposed thereover, disposed near one of said left or right edges;

at least one substantially circular well formed in said planar work surface, disposed near said distal edge; and selectively operable means, connected to said planar work surface near said distal edge, for holding a workpiece in a fixed position on said planar work surface.

32. A portable workstation as recited in claim 31 wherein:

said opening in said rigid box has a cover fitted thereover that is selectively and alternately operable for closing said box and for providing access to the interior of said box.

33. A portable work station, particularly suited for use by a child, comprising in combination;

a substantially quadrilateral panel forming a planar work surface on its upper face and having an opposing lower face, distal and proximal edges, and left and right edges;

a deformable support bag connected to said lower face of said substantially quadrilateral panel, said deformable support bag including a storage volume interior to said deformable support bag having an opening parallel to one of said distal, proximal, left or right edges of said planar work surface;

said storage volume being defined by a rigid box inserted into said deformable support bag and said opening being an opening at one end of said rigid box;

at least one substantially rectangular storage well formed in said planar work surface and having a selectively closable cover disposed thereover, disposed near one of said left or right edges;

at least one substantially circular well formed in said planar work surface, disposed near said distal edge; and book holding means, disposed near said distal edge, for holding a book in a reading position above said planar work surface.

34. A portable workstation as recited in claim 33 wherein:

said opening in said rigid box has a cover fitted thereover that is selectively and alternately operable for closing said box and for providing access to the interior of said box.

35. A portable work station, particularly suited for use by a child, comprising in combination;

a substantially quadrilateral panel formed in a planar work surface on its upper face and having an opposing lower face, distal and proximal edges, and left and right edges;

a deformable support bag connected to said lower face of said substantially quadrilateral panel, said deformable support bag including a storage volume interior to said deformable support bag having an opening parallel to one of said distal, proximal, left or right edges of said planar work surface;

said storage volume being defined by a rigid box inserted into said deformable support bag and said opening being an opening at one end of said rigid box;

at least one substantially rectangular storage well formed in said planar work surface and having a selectively closable cover disposed thereover, disposed near one of said left or right edges;

at least one substantially circular well formed in said planar work surface, disposed near said distal edge;

selectively operable means, connected to said planar work surface near said distal edge, for holding a workpiece in a fixed position on said planar work surface; and book holding means disposed near said distal edge for holding a book in reading position above said planar work surface.

36. A portable workstation as recited in claim 35 wherein:

said opening in said rigid box has a cover fitted thereover that is selectively and alternately operable for closing said box and for providing access to the interior of said box.

* * * * *